US008280611B2

(12) United States Patent
Förster et al.

(10) Patent No.: US 8,280,611 B2
(45) Date of Patent: Oct. 2, 2012

(54) METHOD FOR ADAPTING A DRAG COEFFICIENT OF A FLOW CONTROL VALVE

(75) Inventors: Christoph Förster, Kriftel (DE); Matthias Wiese, Aschaffenburg (DE)

(73) Assignee: Continental Automotive GmbH, Hannover (DE)

( * ) Notice: Subject to any disclaimer, the term of this patent is extended or adjusted under 35 U.S.C. 154(b) by 788 days.

(21) Appl. No.: 12/518,020

(22) PCT Filed: Nov. 28, 2007

(86) PCT No.: PCT/EP2007/062957

§ 371 (c)(1),
(2), (4) Date: Jun. 5, 2009

(87) PCT Pub. No.: WO2008/068177

PCT Pub. Date: Jun. 12, 2008

(65) Prior Publication Data

US 2010/0318231 A1 Dec. 16, 2010

(30) Foreign Application Priority Data

Dec. 6, 2006 (DE) ..... 10 2006 057 524

(51) Int. Cl.

| | |
|---|---|
| ***F02M 51/00*** | (2006.01) |
| *F02D 13/04* | (2006.01) |
| *F02D 41/38* | (2006.01) |
| *F02D 41/20* | (2006.01) |

(52) U.S. Cl. ..... 701/103

(58) Field of Classification Search ..... 701/103–105; 123/478, 480; 700/282

See application file for complete search history.

(56) References Cited

U.S. PATENT DOCUMENTS

| | | | | |
|---|---|---|---|---|
| 5,819,196 | A | 10/1998 | Holmes et al. | 701/103 |
| 6,192,860 | B1 * | 2/2001 | Hatlen | 123/352 |
| 6,581,574 | B1 | 6/2003 | Moran et al. | 123/497 |
| 8,091,529 | B2 * | 1/2012 | Forster et al. | 700/282 |
| 2010/0307456 | A1 * | 12/2010 | Hengl-Betz et al. | 123/478 |

FOREIGN PATENT DOCUMENTS

| | | | |
|---|---|---|---|
| DE | 102004039311 | A1 | 2/2006 |
| DE | 102004049812 | A1 | 4/2006 |
| EP | 1319139 | B1 | 4/2006 |
| WO | 2006/040212 | A1 | 4/2006 |

OTHER PUBLICATIONS

German Office Action, German application No. 10 2006 057 524.5-26, 3 pages, Jun. 18, 2007.

International PCT Search Report and Written Opinion, PCT/EP2007/062957, 10 pages, Mailed Apr. 11, 2008.

* cited by examiner

*Primary Examiner* — Hieut Vo

(74) *Attorney, Agent, or Firm* — King & Spalding L.L.P.

(57) ABSTRACT

A regulating method and a regulating device for actuating an actuator in an injection system for an internal combustion engine, may have the following steps: stipulation of a setpoint value for a controlled variable of the actuator; determination of an actual value of the controlled variable; determination of a setpoint/actual value deviation between the setpoint value and the actual value of the controlled variable; pilot control of a controlled variable in accordance with a predefined pilot control response as a function of the setpoint value; regulation of the controlled variable by a regulator output variable in accordance with a predefined regulating response as a function of the feedback setpoint/actual value deviation; actuation of the actuator with the pilot-controlled and regulated controlled variable; and determination of a characteristic variable of the injection system as a function of the regulator output variable.

20 Claims, 3 Drawing Sheets

METHOD FOR ADAPTING A DRAG COEFFICIENT OF A FLOW CONTROL VALVE

CROSS-REFERENCE TO RELATED APPLICATIONS

This application is a United States national phase filing under 35 U.S.C. §371 of International Application No. PCT/EP2007/062957, filed Nov. 28, 2007 which claims priority to German Patent Application No. 10 2006 057 524.5, filed Dec. 6, 2006. The complete disclosure of the above-identified application is hereby fully incorporated herein by reference.

TECHNICAL FIELD

The invention relates to a control method and a corresponding control device for controlling an actuator in an injection system for an internal combustion engine as claimed in the independent claims.

BACKGROUND

Modern injection systems for internal combustion engines in motor vehicles typically have a high-pressure fuel circuit via which the injection valves of the internal combustion engine are supplied with fuel, there being disposed in the high-pressure fuel circuit a volume control valve (VCV) which allows a specific volumetric flow of fuel to pass through as a function of the manner in which it is controlled. The volume control valve is conventionally controlled via an output stage by means of a pulse-width-modulated voltage signal whose duty factor is varied as a function of the desired degree of opening of the volume control valve. In order to regulate the control of the volume control valve the electric current flowing through the volume control valve, which represents the degree of opening of the volume control valve, is measured, for example at the end of each cycle interval of the pulse-width-modulated control signal. As a function of the thus determined actual value of the current flowing through the volume control valve or, as the case may be, of the corresponding degree of opening of the volume control valve, the duty factor of the pulse-width-modulated control signal is then varied in the course of a correcting action in order to set the desired degree of opening of the volume control valve.

What is problematic about the above-described conventional method of controlling a volume control valve is the fact that the resistance value of the system for controlling the volume control valve can vary dependent on temperature. The controller must then compensate for variations of said kind in the resistance value by means of a relatively strong controller output signal, which, given the temperature-induced variations in the resistance occurring during operation, necessitates a significant correction.

SUMMARY

The above-described conventional method of controlling a volume control valve can be improved according to various embodiments. According to various embodiments, even in the case of temperature-induced variations in the resistance, the controller must output only the smallest possible controller output signal in order to compensate for the temperature-induced variations in the resistance value.

According to an embodiment, a control method for controlling an actuator in an injection system for an internal combustion engine, may comprise the following steps: a) Specification of a setpoint value for a controlled variable of the actuator, b) measurement of an actual value of the controlled variable, c) calculation of a setpoint/actual deviation between the setpoint value and the actual value of the controlled variable, d) pilot control of an actuating variable in accordance with a predefined pilot control behavior as a function of the setpoint value, e) correction of the actuating variable by means of a controller output variable in accordance with a predefined control behavior as a function of the fed-back setpoint/actual deviation, f) control of the actuator by means of the pilot-controlled and corrected actuating variable, and g) determination of a characteristic variable of the injection system as a function of the controller output variable.

According to a further embodiment, the control method may comprise the following step: Setting of the pilot control behavior as a function of the determined characteristic variable. According to a further embodiment, the pilot control behavior can be set as a function of the determined characteristic variable in such a way that the controller output variable is minimized. According to a further embodiment, the determined characteristic variable of the injection system may represent a physical variable. According to a further embodiment, the determined characteristic variable of the injection system can be a temperature value or a resistance value. According to a further embodiment, the characteristic variable of the injection system can be determined in a stationary operating state. According to a further embodiment, the actuating variable can be corrected by means of an integral component, the characteristic variable being determined as a function of the integral component. According to a further embodiment, the pilot-controlled actuating variable can be multiplied by the integral component of the controller output signal. According to a further embodiment, the actuating variable can be corrected by means of a proportional component. According to a further embodiment, the control method may comprise the following steps: a) calculation of a sum from the predefined setpoint value and the proportional component of the controller output signal, and b) pilot control of the actuating variable as a function of the sum of the setpoint value and the proportional component. According to a further embodiment, the actuator can be a valve, in particular a volume control valve, in an injection system for an internal combustion engine.

According to another embodiment, a control device for controlling an actuator in an injection system for an internal combustion engine, may comprise a) a pilot control for controlling the actuator by means of an actuating variable in accordance with a predefined pilot control behavior as a function of a predefined setpoint value for a controlled variable of the actuator, and b) a controller for correcting the actuating variable by means of a controller output variable in accordance with a predefined control behavior as a function of a fed-back setpoint/actual deviation, c) an evaluation unit which determines a characteristic variable of the injection system as a function of the controller output variable.

According to a further embodiment, the control device may comprise an adaptation unit for adapting the pilot control behavior as a function of the determined characteristic variable of the injection system. According to a further embodiment, the controller may output a controller output variable with an integral component. According to a further embodiment, the control device may comprise a multiplier which multiplies the pilot-controlled actuating variable by the integral component of the controller output signal. According to a further embodiment, the controller may output a controller output variable with a proportional component. According to a further embodiment, an adder may multiply the setpoint value for the controlled variable by the proportional component of the controller output signal ahead of the pilot control. According to a further embodiment, the actuator can be a valve, in particular a volume control valve, in an injection system for an internal combustion engine.

BRIEF DESCRIPTION OF THE DRAWINGS

Other advantageous developments are explained in more detail below in conjunction with the description of the preferred exemplary embodiment with reference to the figures, in which.

DETAILED DESCRIPTION

Figure 1:
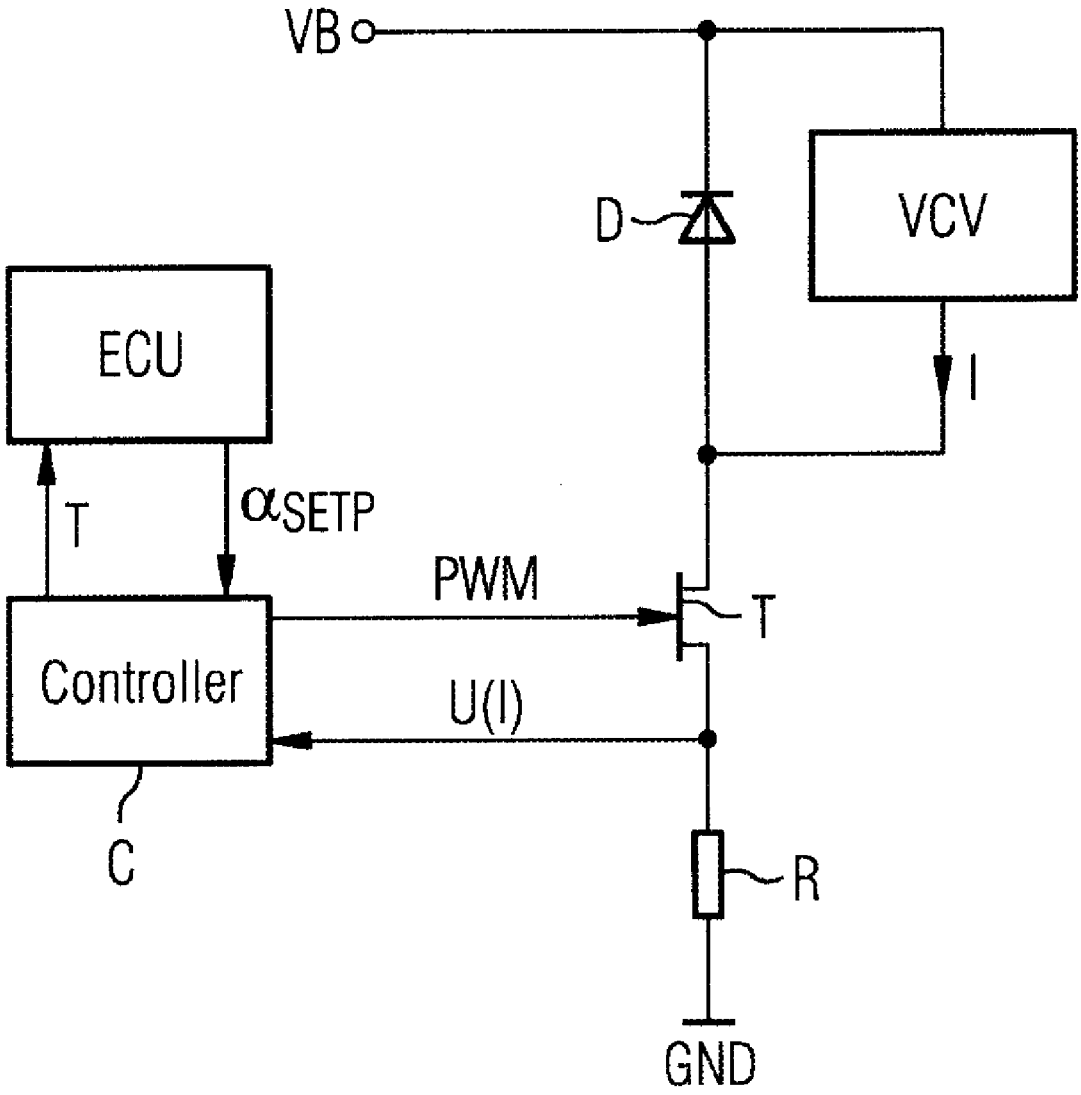
FIG. 1 shows a simplified circuit diagram of a circuit for controlling a volume control valve in an injection system for an internal combustion engine.

According to various embodiments, preferably, a setpoint value for a controlled variable of the actuator is initially specified in the course of the control method. The actuator is preferably a volume control valve in an injection system for an internal combustion engine, while the controlled variable is preferably the electric current flowing through the volume control valve, which current represents, by means of its temporal mean value, the degree of opening of the volume control valve.

An actual value of the controlled variable, i.e. a current measurement, is preferably determined in addition in the course of the control method according to various embodiments. The current measurement can be performed by means of, for example, an analog/digital converter which measures the electrical voltage which drops across a resistance connected in series with the volume control valve and which is therefore directly proportional to the electric current flowing through the volume control valve.

In addition, a setpoint/actual deviation between the predefined setpoint value and the determined actual value of the controlled variable is calculated in the course of the control method according to various embodiments.

In the course of the control method according to various embodiments, the actuator is then controlled by means of a pilot-controlled and corrected actuating variable, where said variable can be, for example, a pulse-width-modulated control signal whose duty factor can be varied in order to set the desired setpoint value.

For the purpose of setting the desired setpoint value of the controlled variable, according to various embodiments, on the one hand, a pilot control which sets the actuating variable without feedback in accordance with a predefined pilot control behavior as a function of the setpoint value.

On the other hand, the control method according to various embodiments for setting the setpoint value provides a way of correcting the actuating variable by means of a controller output variable which is determined in accordance with a predefined control behavior as a function of the fed-back setpoint/actual deviation.

According to various embodiments a characteristic variable can be provided (e.g. the temperature-dependent resistance) of the injection system to be determined as a function of the controller output variable. In this case respective embodiments proceed on the basis of the technical knowledge that during stationary operation the controller output variable, i.e. normally the current correction, is dependent on the change in the electrical resistance in the system for controlling the volume control valve, so the current correction allows a deduction to be made in respect of the change in resistance and hence the temperature.

The determined characteristic variable (e.g. temperature) can be transmitted, for example, to the electronic engine controller (ECU: Electronic Control Unit), which takes the temperature into account when controlling the injection system.

However, it is also possible, according to various embodiments, for the determined characteristic variable (e.g. temperature) of the injection system to be used in order to set the pilot control behavior as a function of the determined characteristic variable. In this case the pilot control behavior is preferably set as a function of the determined characteristic variable in such a way that the controller output variable is minimized. In the case of a temperature-induced change in the resistance in the system for controlling the volume control valve, this change is therefore taken into account in the course of the pilot control, with the result that the controller has to generate only a small controller output signal and in addition can be optimized for dynamic changes.

The determined characteristic variable can be, for example, a physical variable of the injection system, such as, for example, the resistance in the system for controlling the actuator. From the resistance, the temperature can then be calculated if the temperature dependence of the resistance is assumed to be known.

The characteristic variable of interest (e.g. temperature) of the injection system is preferably determined in a static or stationary operating state of the injection system, i.e. when a temporally constant setpoint value is predefined.

According to various embodiments, the actuating variable is preferably corrected by means of an integral component, the characteristic variable of interest being determined as a function of the integral component.

The integral component of the controller output signal is then preferably multiplied by the pilot-controlled actuating variable in order subsequently to control the actuator.

In addition, the actuating variable is preferably corrected also by means of a proportional component which is contained in the controller output signal. The proportional component is preferably taken into account within the scope of the control method in that the proportional component is added to the predefined setpoint value so that the sum of these two signals is then incorporated into the pilot control.

It was already mentioned in the foregoing that the actuator, according to various embodiments, is preferably a volume control valve in an injection system for an internal combustion engine. However, the control method according to various embodiments is also suitable for controlling other actuating elements (e.g. valves) in an injection system for an internal combustion engine.

The circuit diagram in FIG. 1 shows a greatly simplified circuit for controlling a volume control valve VCV in an injection system for an internal combustion engine, the circuit diagram serving only to illustrate the control method according to various embodiments and therefore being greatly simplified for clarity of illustration reasons.

The volume control valve VCV is connected on its voltage side to a battery voltage VB which is provided by the electrical system of a motor vehicle and can have a voltage of, for example, +12V.

On its ground side, on the other hand, the volume control valve VCV is connected to ground GND via an output stage T (shown only schematically here) and a resistance R connected in series with the output stage T.

Connected in parallel with the volume control valve VCV is what is termed a freewheeling diode D, which circuit arrangement is known per se from the prior art.

The output stage T is controlled by a controller C by means of a pulse-width-modulated control signal PWM, the output stage T being low-active, i.e. the output stage T switches through when the control signal PWM assumes a low level, whereas the output stage T blocks when the pulse-width-modulated control signal PWM has a high level.

On the input side, the controller C assumes a setpoint value $\alpha_{SETP}$ for the degree of opening of the volume control valve VCV, where the setpoint value $\alpha_{SETP}$ can be provided by an electronic control unit ECU of the injection system.

In addition, the controller C returns a temperature value T to the electronic control unit ECU, the temperature value T being evaluated in the electronic control unit ECU.

The controller C is also connected to a connection point between the output stage T and the resistance R and therefore measures the electrical voltage U(I) dropping across the resistance R, which voltage is directly proportional to the electric current I flowing through the volume control valve VCV.

Figure 2:
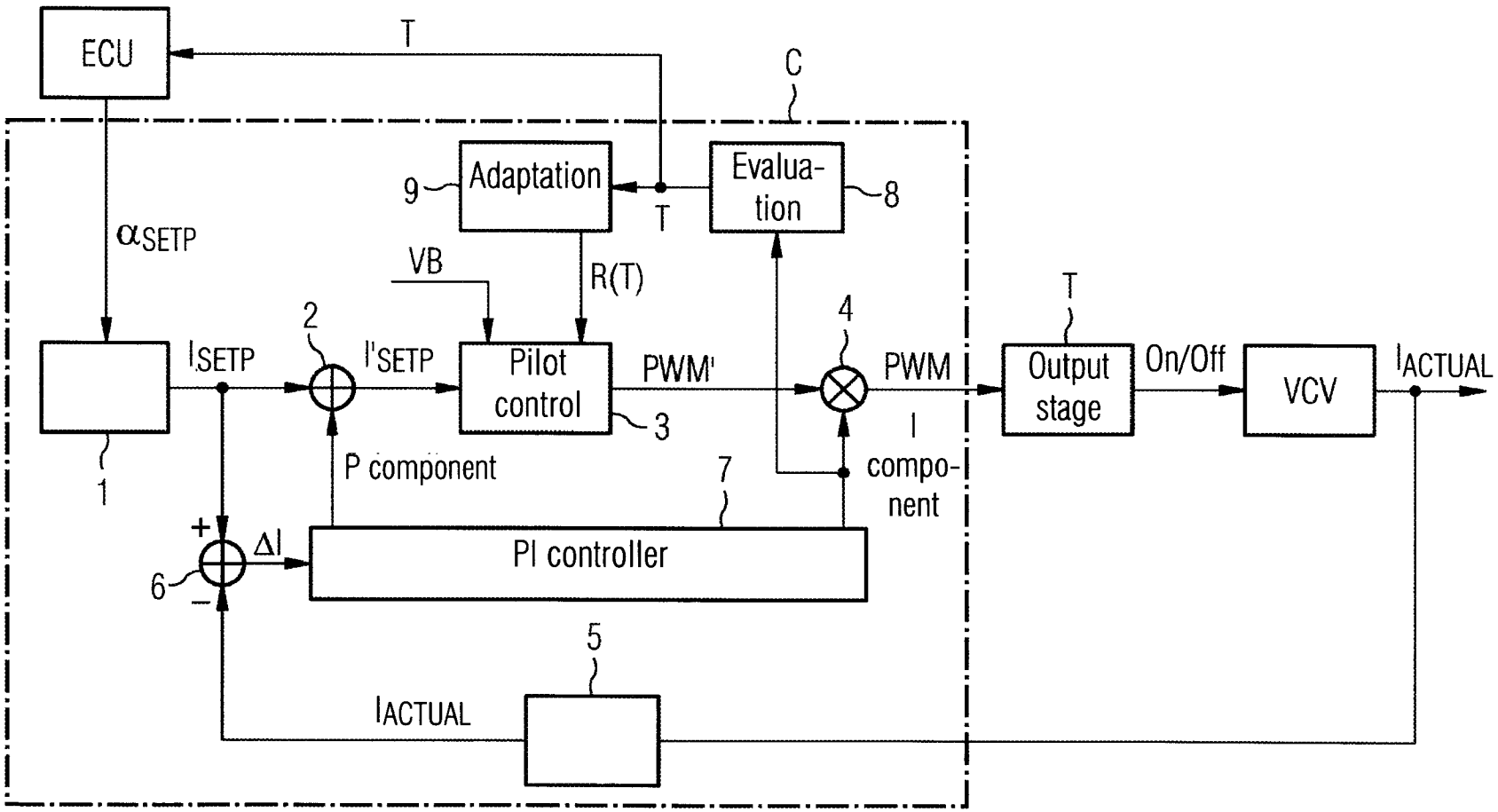
FIG. 2 shows a control-related equivalent circuit diagram of the controller.

The layout of the controller C will now be described below with reference to FIG. 2.

On the input side, the controller C has an assignment unit 1 which assigns to the setpoint value $\alpha_{SETP}$ predefined by the electronic control unit ECU for the degree of opening of the volume control valve VCV a corresponding setpoint value $I_{SETP}$ for the electric current I flowing through the volume control valve VCV.

On the output side, the assignment unit 1 is connected to a pilot control 3 via an adder 2, the pilot control 3 determining a pilot-controlled actuating variable PWM as a function of the setpoint value $I_{SETP}$, said variable being a pulse-width-modulated control signal whose duty factor can be varied for the purpose of setting the desired setpoint value $I_{SETP}$.

On the output side, the pilot control 3 is connected via a multiplier 4 to the output stage T, which switches the current through the volume control valve VCV alternately on and off.

The controller C also has a measuring element 5 which measures an actual value $I_{ACTUAL}$, of the electric current I flowing through the volume control valve VCV and supplies the measured actual value $I_{ACTUAL}$, to a subtractor 6. From the predefined setpoint value $I_{STEP}$ and the measured actual value $I_{ACTUAL}$, the subtractor 6 calculates a setpoint/actual deviation ΔI which is supplied to a controller 7. The controller 7 serves for correcting the actuating variable PWM' as a function of the setpoint/actual deviation ΔI and, as a controller output signal hereto, generates a proportional component and an integral component.

The proportional component of the controller output signal of the controller 7 is supplied to the adder 2, which adds the proportional component to the predefined setpoint value $I_{SETP}$ and calculates a corrected setpoint value $I'_{SETP}$, which is then supplied to the pilot control 3.

The integral component of the controller output signal of the controller 7, on the other hand, is supplied to the multiplier 4, which multiplies the integral component by the pilot-controlled actuating variable PWM' and generates a correspondingly corrected actuating variable PWM, which then serves for controlling the output stage.

In stationary operation, the integral component of the controller output signal of the controller 7 represents a temperature-induced deviation in the resistance R and is therefore supplied to an evaluation unit 8, which calculates a temperature value T in accordance with the known temperature dependence of the resistance R.

On the output side, the evaluation unit 8 is connected on the one hand to the electronic control unit ECU, which takes the calculated temperature value T into account during the further control of the injection system.

On the other hand, the evaluation unit 8 is connected on the output side to an adaptation unit 9, which adapts the pilot control behavior of the pilot control 3 as a function of the temperature value T. In this case the adaptation unit 9 adjusts the pilot control behavior of the pilot control 3 in the stationary operating mode in such a way that the controller output signal of the controller 7 is minimized, with the result that during live operation the controller 7 does not need to compensate for temperature-induced variations in the resistance R or needs to do so only to a minor extent.

Figure 3:
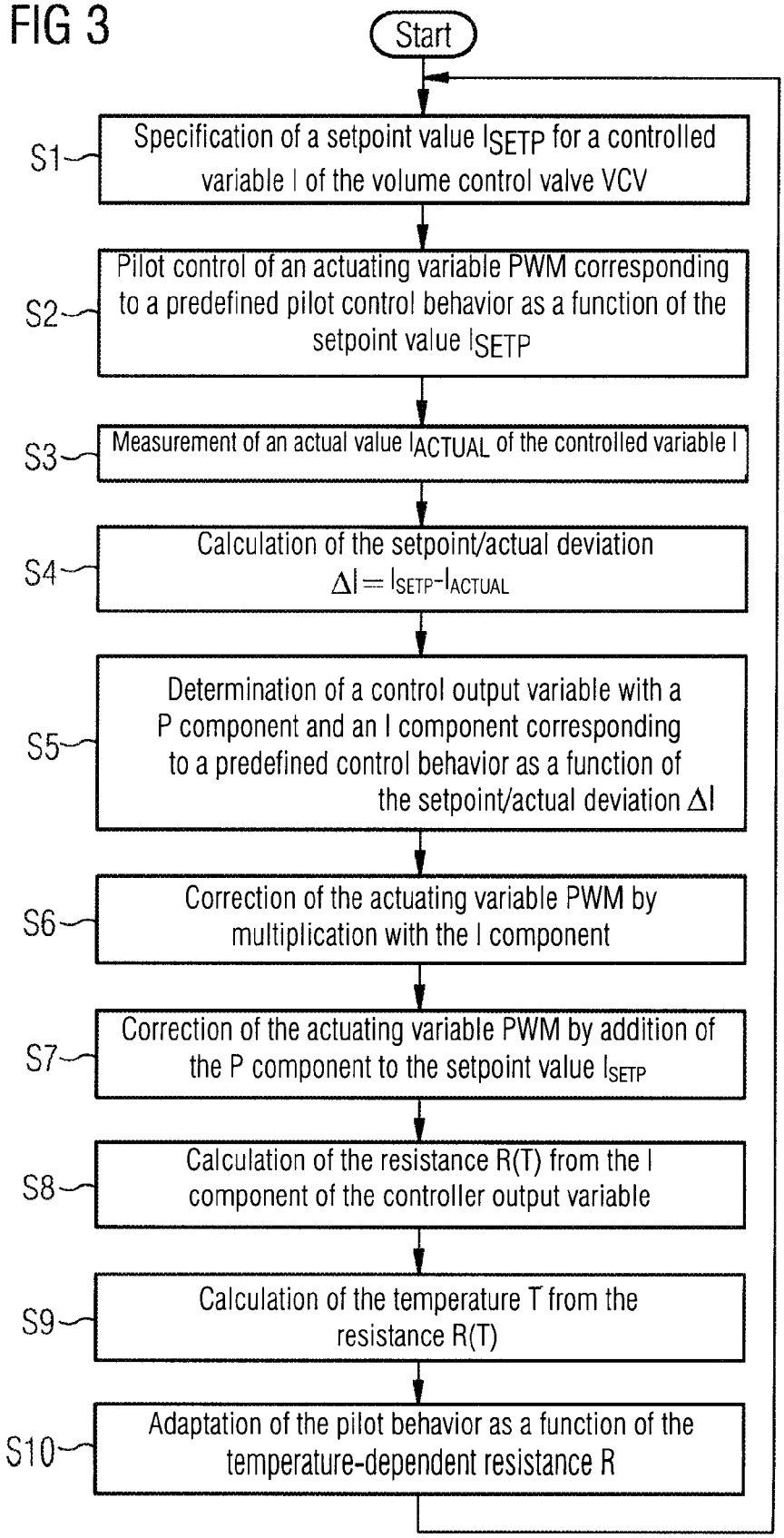
FIG. 3 shows the control method according to an embodiment in the form of a flowchart.

The control method according to an embodiment will now be described below with reference to the flowchart shown in FIG. 3.

In a first step S1, a setpoint value $I_{SETP}$ is initially specified for the electric current I which flows through the volume control valve VCV and which, with its temporal mean value, represents the degree of opening of the volume control valve VCV.

In a further step S2, a pilot control of the actuating variable PWM is then performed in accordance with the predefined pilot control behavior as a function of the setpoint value $I_{SETP}$.

In a further step S3, an actual value $I_{ACTUAL}$ of the electric current I flowing through the volume control valve VCV is then measured.

In the course of the control method according to an embodiment, the setpoint/actual deviation ΔI between the predefined setpoint value $I_{SETP}$ and the measured actual value $I_{ACTUAL}$ is then measured in a step S4.

In a further step S5, a controller output variable comprising a proportional component and an integral component is then determined in accordance with a predefined control behavior as a function of the setpoint/actual deviation ΔI.

In a step S6, the integral component is then used for correcting the actuating variable PWM, whereby the pilot-controlled value PWM' of the actuating variable is multiplied by the integral component.

In a step S7, the proportional component of the controller output variable likewise serves to correct the actuating variable PWM, whereby the proportional component is added to the predefined setpoint value $I_{SETP}$ of the electric current I flowing through the volume control valve VCV ahead of the pilot control.

In addition, in a step S8, the control method according to an embodiment provides that the resistance R is calculated from the integral component of the controller output variable.

In a further step S9, the temperature T is then measured on the basis of the known temperature dependence of the resistance R.

In a step S10, the pilot control behavior is then adapted as a function of the temperature-dependent resistance R.

The invention is not restricted to the preferred exemplary embodiment described in the foregoing. Rather, a multiplicity of variations and modifications are possible which also make use of the inventive concept and therefore fall within the scope of protection.

List of Reference Signs:

1 Assignment unit
2 Adder
3 Pilot control
4 Multiplier
5 Measuring element

6 Subtractor
7 Controller
8 Evaluation unit
9 Adaptation unit
$\alpha_{SETP}$ Setpoint value of the degree of opening of the VCV
C Controller
D Freewheeling diode
ECU Electronic control unit
GND Ground
I Current through the VCV
$I_{ACTUAL}$ Actual value of the current through the VCV
$I_{SETP}$ Setpoint value of the current through the VCV
PWM Pulse-width-modulated actuating variable
R Resistance
S1-S10 Method steps
T Temperature
U Voltage across the resistance R
VB Battery voltage
VCV Volume control valve

The invention claimed is:

1. A control device for controlling an actuator in an injection system for an internal combustion engine, comprising a) a pilot control for controlling the actuator by means of an actuating variable in accordance with a predefined pilot control behavior as a function of a predefined setpoint value for a controlled variable of the actuator, and b) a controller for correcting the actuating variable by means of a controller output variable in accordance with a predefined control behavior as a function of a fed-back setpoint/actual deviation, c) an evaluation unit which determines a characteristic variable of the injection system as a function of the controller output variable.

2. The control device according to claim 1, comprising an adaptation unit for adapting the pilot control behavior as a function of the determined characteristic variable of the injection system.

3. The control device according to claim 1, wherein the controller outputs a controller output variable with an integral component.

4. The control device according to claim 3, comprising a multiplier which multiplies the pilot-controlled actuating variable by the integral component of the controller output signal.

5. The control device according to claim 1, wherein the controller outputs a controller output variable with a proportional component.

6. The control device according to claim 5, comprising an adder which multiplies the setpoint value for the controlled variable by the proportional component of the controller output signal ahead of the pilot control.

7. The control device according to claim 1, wherein the actuator is a valve or a volume control valve in an injection system for an internal combustion engine.

8. A device for controlling an actuator in an injection system for an internal combustion engine, the device being operable:

a) to specify a setpoint value for a controlled variable of the actuator, b) to measure an actual value of the controlled variable, c) to calculate a setpoint/actual deviation between the setpoint value and the actual value of the controlled variable, d) to pilot control an actuating variable in accordance with a predefined pilot control behavior as a function of the setpoint value, e) to correct the actuating variable by means of a controller output variable in accordance with a predefined control behavior as a function of the fed-back setpoint/actual deviation, f) to control the actuator by means of the pilot-controlled and corrected actuating variable, and g) to determine a characteristic variable of the injection system as a function of the controller output variable.

9. The device according to claim 8, further being operable: To set the pilot control behavior as a function of the determined characteristic variable.

10. A control method for controlling an actuator in an injection system for an internal combustion engine, comprising the following steps:

a) Specification of a setpoint value for a controlled variable of the actuator, b) measurement of an actual value of the controlled variable, c) calculation of a setpoint/actual deviation between the setpoint value and the actual value of the controlled variable, d) pilot control of an actuating variable in accordance with a predefined pilot control behavior as a function of the setpoint value, e) correction of the actuating variable by means of a controller output variable in accordance with a predefined control behavior as a function of the fed-back setpoint/actual deviation, f) control of the actuator by means of the pilot-controlled and corrected actuating variable, and g) determination of a characteristic variable of the injection system as a function of the controller output variable.

11. The control method according to claim 10, comprising the following step:

Setting of the pilot control behavior as a function of the determined characteristic variable.

12. The control method according to claim 11, wherein the pilot control behavior is set as a function of the determined characteristic variable in such a way that the controller output variable is minimized.

13. The control method according to claim 10, wherein the determined characteristic variable of the injection system represents a physical variable.

14. The control method according to claim 10, wherein the determined characteristic variable of the injection system is a temperature value or a resistance value.

15. The control method according to claim 10, wherein the characteristic variable of the injection system is determined in a stationary operating state.

16. The control method according to claim 10, wherein the actuating variable is corrected by means of an integral component, the characteristic variable being determined as a function of the integral component.

17. The control method according to claim 16, wherein the pilot-controlled actuating variable is multiplied by the integral component of the controller output signal.

18. The control method according to claim 10, wherein the actuating variable is corrected by means of a proportional component.

19. The control method according to claim 18, comprising the following steps:

a) calculation of a sum from the predefined setpoint value and the proportional component of the controller output signal, b) pilot control of the actuating variable as a function of the sum of the setpoint value and the proportional component.

20. The control method according to claim 10, wherein the actuator is a valve or a volume control valve in an injection system for an internal combustion engine.

* * * * *